US005143059A

United States Patent [19]

Delphia

[11] Patent Number: 5,143,059

[45] Date of Patent: Sep. 1, 1992

[54] WATER TRAP FOR A SNORKEL

[76] Inventor: John B. Delphia, 1021 Schuyler Dr., White Lake, Mich. 48383

[21] Appl. No.: 735,847

[22] Filed: Jul. 25, 1991

[51] Int. Cl.[5] ..... B63C 11/16

[52] U.S. Cl. ..... 128/201.11; 128/207.14

[58] Field of Search ..... 128/200.29, 201.11, 128/201.27, 207.14

[56] References Cited

U.S. PATENT DOCUMENTS 4,655,212 4/1987 Delphia ..... 128/201.11
4,872,453 10/1989 Christianson ..... 128/201.11
4,877,022 10/1989 Christianson ..... 128/201.11
4,879,995 11/1989 Christianson ..... 128/201.11
4,884,564 12/1989 Lamont ..... 128/201.11

*Primary Examiner*—Edgar S. Burr
*Assistant Examiner*—Stephen R. Funk
*Attorney, Agent, or Firm*—Reising, Ethington, Barnard, Perry & Milton

[57] ABSTRACT

A diving snorkel assembly (10) including a water trap (28, 99) disposed within the snorkel tube (12) for trapping water flowing through the tube and disposing of the water through an exhaust valve (26) located along the length of the tube. The trap (28, 99) removes most of the water passing through the tube (12) and makes breathing easier for the diver using the snorkel (10).

17 Claims, 3 Drawing Sheets

WATER TRAP FOR A SNORKEL

FIELD OF THE INVENTION

The subject invention relates to fresh air diving snorkels of the type used in the sport of skin diving.

BACKGROUND OF THE INVENTION

Snorkel users perpetually face breathing problems posed by water entering the snorkel tube. Water enters most snorkel tubes whenever the diver dives below the water surface. Accordingly, it is well known in the snorkel art to attempt to close the air intake opening somehow when the diver dives below the water surface. This has typically been accomplished by curving the top of the snorkel tube so that it faces the water surface, and by attaching a small cage with a floating ball therein. When the diver dives below the water surface, the ball floats into sealing engagement with the top of the snorkel tube to seal the top against water leaking in. It is further known in the art to attempt to channel water already in the tube out of the tube somehow. The U.S. Pat. No. 4,655,212 to Delphia discloses deflecting means disposed near an exhaust valve located along the tube for deflecting water flowing through the tube out of the tube through the exhaust valve. While such deflecting means deflects much of the water flowing through the tube out of the tube, a significant portion of the water remains in the tube to hamper the diver's breathing.

SUMMARY OF THE INVENTION

The subject invention proposes a diving snorkel assembly comprising a snorkel tube having an inner surface defining an air passageway extending between first and second ends of the snorkel tube. The first end of the tube defines an air intake opening in fluid communication with the passageway. The assembly further includes a mouthpiece disposed on the second end of the snorkel tube in fluid communication with the air passageway and adapted to be received into the mouth of a skin diver. The assembly also includes a one-way exhaust valve disposed between the mouthpiece and the air intake opening for allowing one-way flow of fluid out of the snorkel tube. The assembly is characterized by trap means disposed in the air passageway between the exhaust valve and the air intake for trapping liquid flowing through the air passageway and retaining the liquid until the liquid is discharged from the snorkel tube through the exhaust valve.

The snorkel having the trap disposed therein traps nearly all of the water flowing through the snorkel tube and holds it until the water is discharged through the exhaust valve. In this manner, minimal water remains in the tube to hamper the diver's breathing.

FIGURES IN THE DRAWINGS

Other advantages of the present invention will be readily appreciated as the same becomes better understood by reference to the following detailed description when considered in connection with the accompanying drawings wherein.

DESCRIPTION OF THE PREFERRED EMBODIMENT

Figure 1:
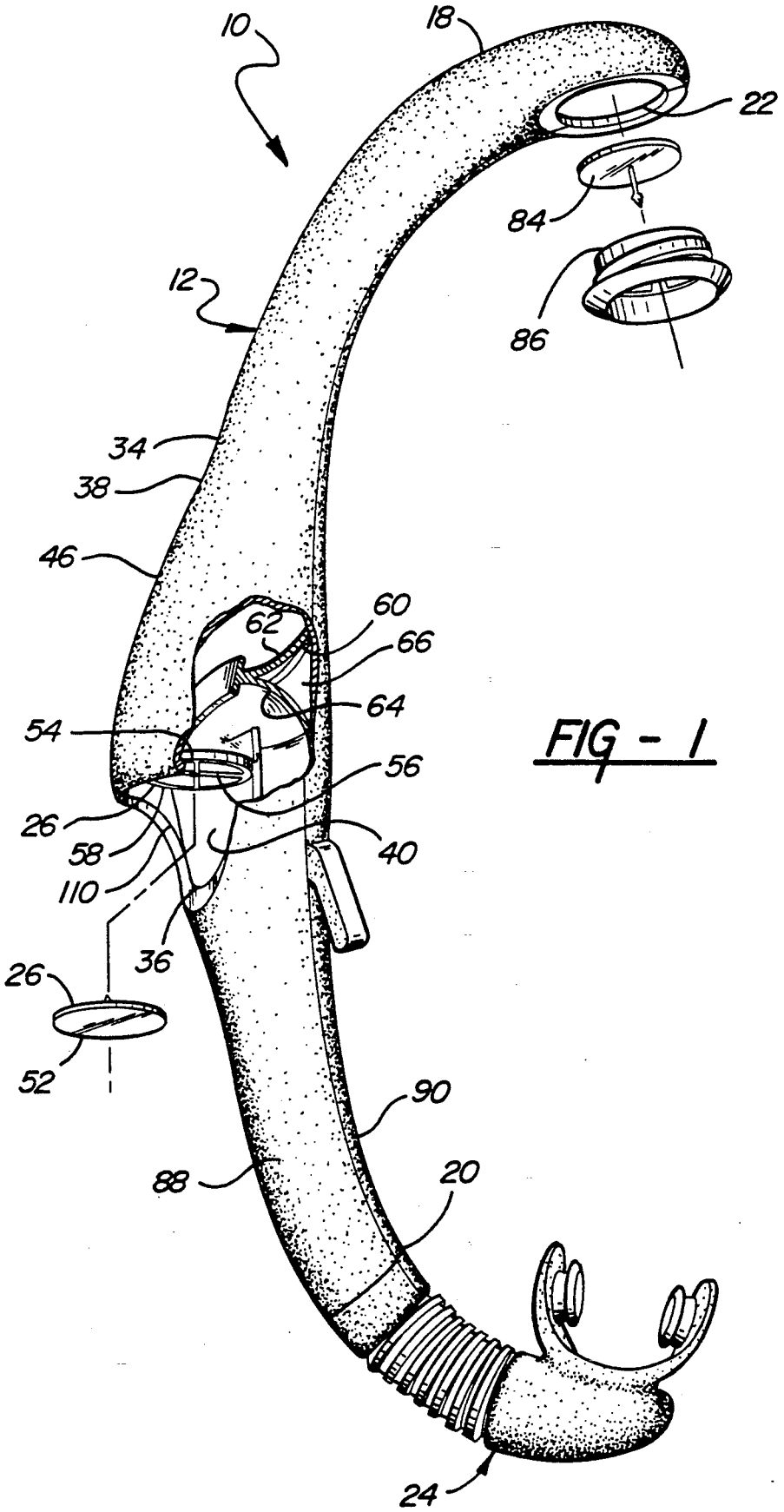
FIG. 1 is a partially exploded perspective view of the snorkel assembly, partially cut away to show the trap means.
Figure 2:
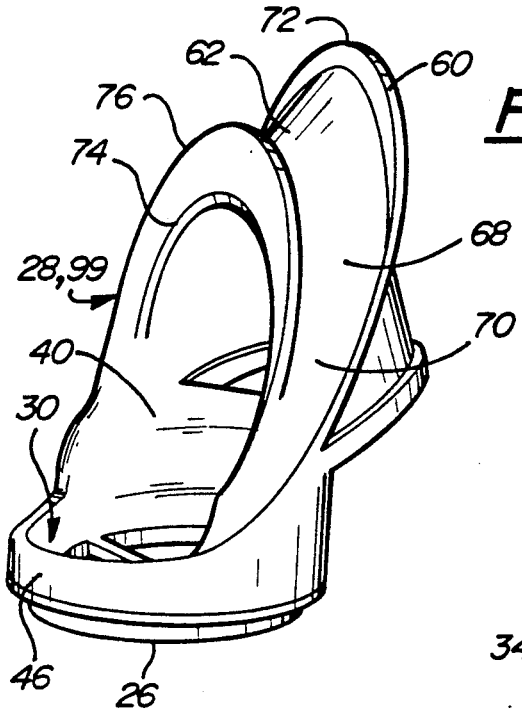
FIG. 2 is a perspective view of a portion of the trap means.
Figure 3:
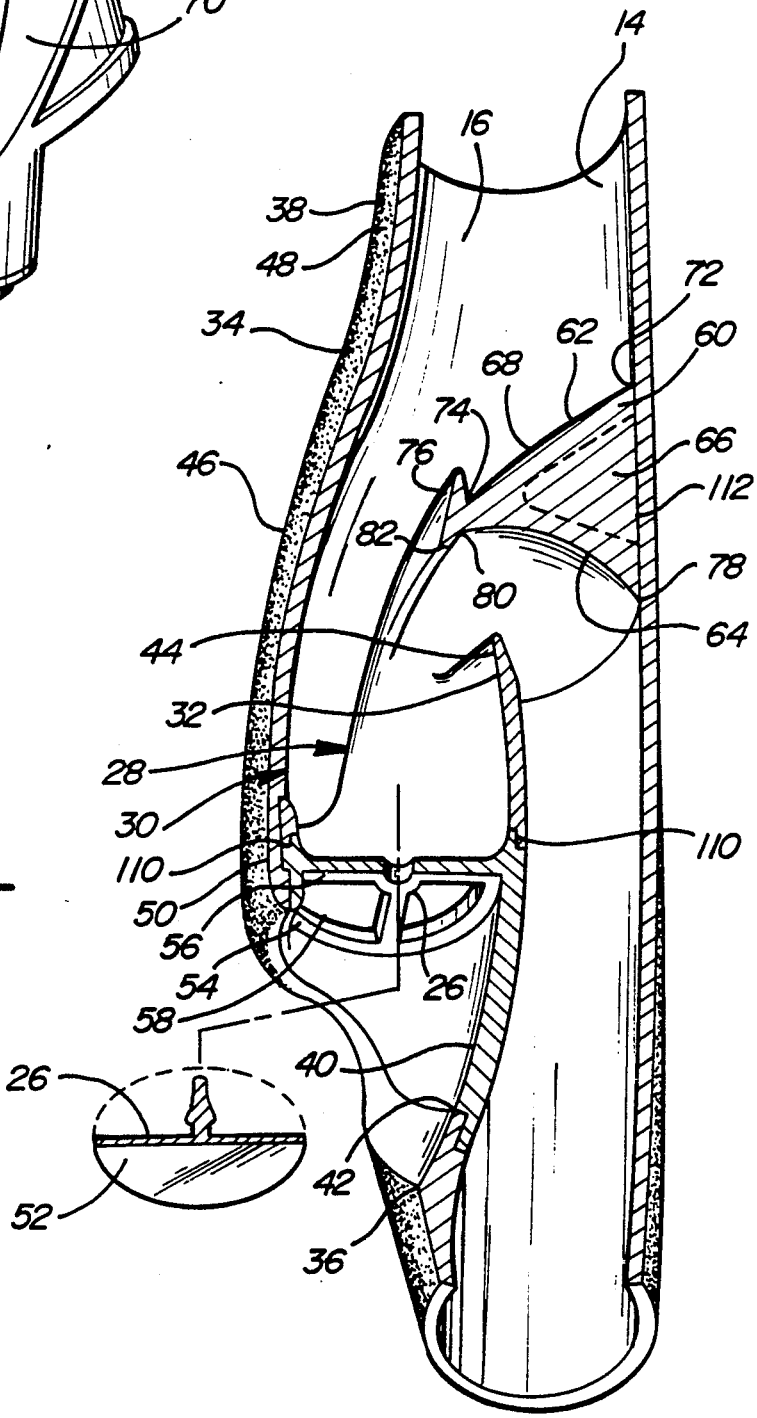
FIG. 3 is a section view of the trap disposed in the snorkel.
Figure 4:
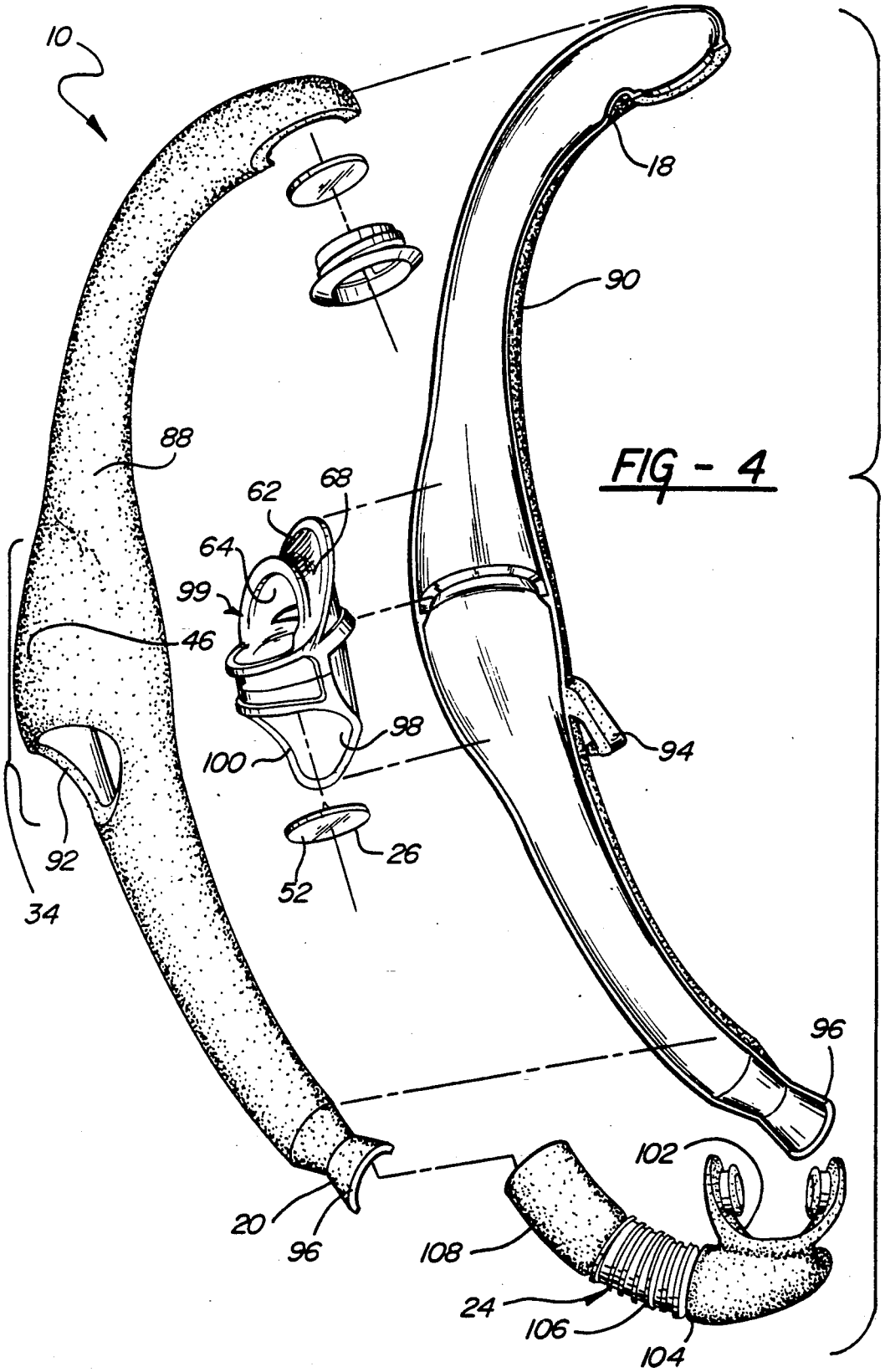
FIG. 4 is an exploded perspective view of the snorkel assembly.

A diving snorkel assembly generally shown at 10 comprises a snorkel tube 12 having an inner surface 14 defining an air passageway 16 extending between a first 18 and a second end 20 of the snorkel tube 12. The first end 18 of the snorkel tube 12 defines an air intake opening 22 in fluid communication with the air passageway 16. A mouthpiece generally indicated at 24 is disposed on the second end 20 of the snorkel tube 12 in fluid communication with the air passageway 16 and is adapted to be received into the mouth of the skin diver. A one way exhaust valve 26 is disposed between the mouthpiece 24 and the air intake opening 22 for allowing a one way flow of fluid out of the snorkel tube 12. The assembly 10 is characterized by trap means generally indicated at 28 disposed in the air passageway 16 between the exhaust valve 26 and the air intake 22 for trapping liquid flowing through the air passageway 16 and retaining the liquid until the liquid is discharged from the snorkel tube 12 through the exhaust valve 26.

The trap means 28 includes duct means generally indicated at 30 surrounding the exhaust valve 26 and extending into the air passageway 16 toward the air intake 22 and terminating at a receiving end 32 between the exhaust valve 26 and the air intake 22. The duct means 30 provides fluid communication between the air passageway 16 and the exhaust valve 26. The snorkel tube 12 includes an opening 34 disposed along its length between the mouthpiece 24 and the air intake opening 22. The opening 34 has a first end 36 and a second 38 end disposed between the first end 36 and the air intake opening 22. The duct means 30 includes a divider 40 having a first end 42 disposed adjacent to the snorkel tube 12 at the first end of the opening 34 and a second end 44 extending within the air passageway 16 toward the second end 38 of the opening 34. The second end 44 of the divider 40 is spaced apart from the second end 38 of the opening 34 and is co-incidental with the aforementioned receiving end 32. The duct means 30 further includes a cover 46 having a first end 48 fixed to the second end 38 of the opening 34 and a second end 50 extending outside of the snorkel tube 12 toward the first end 36 of the opening 34. The second end 50 of the cover 46 is spaced apart from the first end 36 of the opening 34 so that the cover 46 and the divider 40 define the duct means 30. The divider 40 and the cover 46 are generally walls having a semicircular curve which, when placed together, form a generally circular, or possibly oval, tube or duct.

The exhaust valve 26 extends across the duct means 30 between the cover 46 and the divider 40 so that the exhaust valve 26 closes the duct means 30. The exhaust valve 26 has a generally circular cross section, and is situated in a plane perpendicular to the air passageway 16 running through the snorkel tube 12. The exhaust valve 26 can be any typical check valve allowing fluid flow in only one direction. In this case, the exhaust valve 26 consists of a elastic flexible disk or diaphragm 52 fixed to a valve seat 54 including a bridge member 56 extending across a valve hole 58. The center of the disk 52 is fixed to the bridge member 56 at the center of the hole. Edges of the disk 52 can flex away from the valve hole 58 in response to the weight of water building up in the duct means 30, or in response to the diver's exhaling. The edges of the disk flex back to seal the valve hole 58 when the water leaves the duct means 30 through the exhaust valve 26.

The trap means 28 further includes a canopy means 60 extending into the air passageway 16 from the inner surface 14 of the snorkel tube 12 having an upper deflecting surface 62 and a lower deflecting surface 64. The canopy means 60 extends only partly across the air passageway 16 to allow air to flow therethrough. Also, the lower deflecting surface 64 of the canopy means 60 is spaced apart from the receiving end 32 of the duct means 30 to allow air to flow through the air passageway 16 between the receiving end 32 of the duct means 30 and the lower deflecting surface 64 toward the mouthpiece 24. The canopy means 60 includes a hollow pocket 66 adjacent the inner surface 14 of the snorkel tube 12. The hollow pocket 66 is optional and exists only to save weight and material.

The upper deflecting surface 62 is disposed in the air passageway 16 between the receiving end 32 of the duct means 30 and the air intake 22 for channeling liquid flowing from the air intake and through the air passageway 16 into the duct means 30. The upper deflecting surface 62 includes conduit means 68 extending from the canopy means 60 into the duct means 30 for conducting liquid from the canopy means 60 into the duct means 30 and subsequently out of the snorkel tube 12. The conduit means 68 includes at least one semicircular duct 70. In other words, the conduit means 68 has a trough or gutter shape, enabling it to carry the water down into the duct means 30. The upper deflecting surface 62 slopes down from a first end 72 adjacent the inner surface 14 of the snorkel tube 12 toward the duct means 30 to a second end 74, located roughly in the middle of the air passageway 16. The sloped upper deflecting surface 62 prevents water buildup on the surface by channeling it down into the duct means 30. The second end 74 of the upper deflecting surface 62 includes an upper lip 76 which extends up and toward the inner surface 14 of the snorkel tube 12 to which the canopy means 60 is attached. The upper lip 76 thus forms an acute angle with the upper deflecting surface 62 in cross-section. The upper lip 76 prevents water from flowing around the canopy means 60 from the upper deflecting surface 62 to the lower deflecting surface 64, where it is free to fall into the air passageway 16 toward the mouthpiece 24.

The canopy means 60 further includes a lower deflecting surface 64 disposed in the air passageway 16 between the receiving end 32 of the duct means 30 and the upper deflecting surface 62 for deflecting liquid flowing from the mouthpiece 24 into the duct means 30. The lower deflecting surface 64 slopes up from a first end 78 adjacent the inner surface 14 of the snorkel tube 12 toward the air intake opening 22 to a second end 80. A lower lip 82 extends down from the second end 80 of the lower deflecting surface 64 toward the duct means 30. The lower lip 82, roughly collinear with the upper lip 76, forms an obtuse angle with the lower deflecting surface 64 in cross-section. The lower deflecting surface 64 and the lower lip 82 are thus configured to maximize the amount of water channeled from the mouthpiece 24 into the duct means 30, and to minimize the amount of water deflected back down the air passageway 16 toward the mouthpiece 24. The slant on the lower lip 82 also serves to further prevent water from flowing around the canopy means from the upper deflecting surface 62 to the lower deflecting surface 64.

The assembly 10 further includes a one way air intake valve 84 disposed in the air passageway 16 adjacent the air intake opening 22. This valve is, like the exhaust valve 26, a check valve. The intake valve 84 may be a valve similar to the exhaust valve 26. Preferably, the intake valve 84 is a floating intake valve of the type disclosed in a co-pending Delphia U.S. patent application. This valve 84, not just its edges, moves totally toward and away from the valve seat 86 in response to the inhaling and exhaling of the diver.

The duct means 30 constitutes a significant portion of the cross section of the air passageway 16. Accordingly, if any water flows into the air passageway 16 from the air intake opening 22, some will flow directly into the duct means 30. The water not flowing directly into the duct means 30 will hit the upper deflecting surface 62 of the canopy means 60, which projects over the portion of the air passageway 16 not taken up by the duct means 30 (i.e. the portion which leads directly to the mouthpiece 24). The conduit means 68 on the upper deflecting surface 62 will conduct this water into the duct means 30.

If, somehow, water flows from the mouthpiece 24, usually in response to a burst of air from the diver, this water will hit the lower deflecting surface 64 on the bottom of the canopy means 60 and be deflected into the duct means 30.

Meanwhile, air is free to flow into the air passageway 16 from the air intake valve 84, down past and under the canopy means 60, over the duct means 30 and toward the mouthpiece 24.

The snorkel 10 may be formed somehow with the water trap 28 inside and integral with the snorkel tube 12. In the preferred embodiment, the snorkel 10 is manufactured by assembling various pieces. The pieces include a first longitudinal half 88 and a second longitudinal half 90 which, when assembled, form the snorkel tube 12. In particular, the first and second halves 88, 90 are non-symmetrical halves oriented about the axis coincident with the axis of the air passageway 16. The first half 88 includes the cover portion 46 and a hole 92. The second half 90 includes a locator clip 94 preferably molded as part of the second half 90 for attaching to the diver's mask strap and for locating the hole 92 the proper distance above the water level. Both halves do have symmetrical end portions 96 which, when the two halves 88, 90 are attached, snap into connection with the mouthpiece 24.

The trap means 28, in this case, is a trap unit generally indicated at 99 separate from the two halves 88, 90. The trap unit 99 includes what are equivalents to the canopy means 60, the duct means 30 and the exhaust valve 26. The trap unit 99 additionally includes an exhaust duct 98 coaxial with the duct means 30 and extending away from the exhaust valve 26 on the opposite side of the exhaust valve 26 from the duct means 30. The exhaust duct 98 includes an exhaust opening 100 from which liquid can flow out of the exhaust duct 98.

The mouthpiece 24 is also formed separately from the snorkel tube halves 88, 90. The mouthpiece 24 includes a mouth portion 102, and a length of mouthpiece tube 104. The mouthpiece tube 104 includes a flexible accordion type portion 106 and an attachment portion 108 for attaching to the first and second halves 88, 90 once they have been joined to one another. The attachment portion 108 includes means (not shown) for attaching to the end portions 96 of the snorkel tube 12. This means may be a convex section within the attachment portion for fitting into a concave portion in the end portions 96.

To assemble the various pieces, one first places the trap 28 unit 99 into engagement with the first longitudinal half 88 so that the hole 92 and the exhaust valve 26 are in fluid engagement with each other, with the exhaust duct 98 in between. There should be an airtight seal 110 between the first half 88 and the trap unit 99 so that fluid from outside the snorkel tube 12 can only flow through the hole into the exhaust duct 98, and not through the hole and into the air passageway 16.

Next, the second half 90 of the snorkel tube 12 can be fixed to the first half 88, generally sealing the trap unit 99 inside the two halves. There should be watertight seals 112 between the trap unit 9 and portions of the inner surface 14 of the snorkel tube halves 88, 90 which the trap 28 unit touches. This ensures that water cannot flow between the trap unit 99 and the inner surfaces 14 of the snorkel tube 12 without being trapped by being channeled into the duct means 30. The first half of the snorkel tube 12 should be welded or glued to the second half 90 of the snorkel tube 12 to ensure an airtight fit. The preferred manner of fastening the two halves 88, 90 is to weld them together.

Finally, the mouthpiece 24 is snapped into engagement with the snorkel tube halves 88, 90 so that the mouthpiece 24 is in fluid engagement with the halves. The preferred manner of engagement is one which allows the mouthpiece 24 to rotate with respect to the halves 88, 90.

In operation, the snorkel 10 is fitted to the diver's mask with the locator clip 94 attaching to the mask strap. This locates the snorkel 10 in such a manner that the hole 92 is maintained a certain distance above the waterline. If any water enters the tube 12 through the air intake opening 22, it will move down the air passageway 16 until it reaches the area of the trap means 28. Some water will fall directly into the duct means 30. The remainder of the water will hit the upper deflecting surface 62, where it will be channeled by the conduit means 68 into the duct means 30. In either case, water in the duct means 30 will be expelled from the snorkel tube 12 through the exhaust valve 26 at the bottom of the duct means 30 The water expelled through the exhaust valve 30 will move down through the exhaust duct 98 and out the exhaust opening 100 into the environment. If water somehow gets into the snorkel tube 12 below the trap means 28, i.e. near the mouthpiece 24, the diver can blow the water up the tube by exhaling. The water will be deflected by the lower deflecting surface 64 into the duct means 30, where it will be expelled from the snorkel 10 as described above.

The invention has been described in an illustrative manner, and it is to be understood that the terminology which has been used is intended to be in the nature of words of description rather than of limitation.

Obviously, many modifications and variations of the present invention are possible in light of the above teachings. It is therefore to be understood that within the scope of the appended claims wherein reference numerals are merely for convenience and are not to be in any way limiting, the invention may be practiced otherwise than as specifically described.

What is claimed:

1. A diving snorkel assembly (10) comprising:

a snorkel tube (12) having an inner surface (14) defining an air passageway (16) extending between first (18) and second ends (20) of said snorkel tube, said first end (18) defining an air intake opening (22) in fluid communication with said passageway;

a mouthpiece (24) disposed on said second end of said snorkel tube (12) in fluid communication with said air passageway (16) and adapted to be received into the mouth of a skin diver;

a one-way exhaust valve (26) disposed between said mouthpiece (24) and said air intake opening (22) for allowing one-way flow of fluid out of said snorkel tube (12);

trap (28) means disposed in said air passageway (16) between said exhaust valve (26) and said air intake (22) for trapping liquid flowing through said air passageway (16) and retaining the liquid until the liquid is discharged from said snorkel tube (12) through said exhaust valve (26);

said trap means including duct means (30) surrounding said exhaust valve (26), extending into said air passageway (16) toward said air intake (22) and terminating at a receiving end (32) between said exhaust valve (26) and said air intake for providing fluid communication between said air passageway (16) and said exhaust valve (26);

said trap means further including canopy means (60) disposed in said air passageway (16) between said receiving end (32) of said duct means (30) and said air intake (22) for channeling liquid flowing through said air passageway (16) into said duct means (30);

said canopy means (60) including an upper deflecting surface (62) and a lower deflecting surface (64) disposed between said upper deflecting surface and said receiving end (32) of said duct means (30);

said upper deflecting surface (62) being sloped down from a first end (72) adjacent said inner surface (14) of said snorkel tube (12) toward said duct means (30) to a second end (74).

2. An assembly (10) as set forth in claim 1 further defined by said lower deflecting surface (64) sloping up from a first end (78) adjacent said inner surface (14) of said snorkel tube (12) toward said air intake opening (22) to a second end (80).

3. An assembly (10) as set forth in claim 2 further defined by said upper deflecting surface (62) of said canopy means (60) including conduit means (68) extending from said canopy means (60) into said duct means (30) for conducting liquid from said canopy means (60) into said duct means (30) and out of said snorkel tube (12).

4. An assembly (10) as set forth in claim 3 further defined by said conduit means (68) including at least one semicircular duct (70).

5. An assembly (10) as set forth in claim 4 further defined by said upper deflecting surface (62) including an upper lip (76) disposed on said second end (74) and sloping up toward said air intake opening (22).

6. An assembly (10) as set forth in claim 5 further defined by said lower deflecting surface (64) including a lower lip (82) disposed on said second end (80) and sloping down toward said duct means (30).

7. An assembly (10) as set forth in claim 6 further defined by including a one way air intake valve (84) disposed in said air passageway (16) adjacent said air intake opening (22).

8. An assembly (10) as set forth in claim 7 further defined by said snorkel tube (12) including a first longitudinal half (88) separate from but attachable to a second longitudinal half (90).

9. An assembly (10) as set forth in claim 8 further defined by including a single piece trap unit (99) separate from said first and second halves (88, 90) defining said canopy means (60), said duct means (30) and said exhaust valve (26) so that when said trap unit (99) is placed in said snorkel tube halves (88, 90) liquid can be channeled from said canopy means (60) into said duct means (30) toward said exhaust valve (26), and then through said exhaust valve (26).

10. An assembly (10) as set forth in claim 9 further defined by said trap unit (99) including an exhaust duct (98) coaxial with said duct means (30) and extending away from said exhaust valve (26) and including an exhaust opening (100), so that liquid flows from said exhaust valve (26) through said exhaust duct (98) and out of said exhaust opening (100).

11. An assembly (10) as set forth in claim 10 further defined by said first longitudinal half (88) defining a hole (92) corresponding in size and shape to said exhaust opening (100).

12. An assembly (10) as set forth in claim 11 further defined by said exhaust valve (26) extending across said duct means (30) so that said exhaust valve closes said duct means.

13. An assembly (10) as set forth in claim 12 further defined by said canopy means (60) defining a hollow pocket (66) adjacent said inner surface (14) of said snorkel tube (12).

14. An assembly (10) as set forth in claim 13 further defined by including an airtight seal (110) between said hole (92) and said exhaust opening (100) so that fluids can flow between said exhaust valve (26) and said hole (92) through said exhaust duct (98) and so that fluids cannot flow through said hole (92) into said air passageway (16) of said snorkel tube (12).

15. An assembly (10) as set forth in claim 14 further defined by including a watertight seal (112) between said trap unit (99) and said inner surface (14) of said snorkel tube (12).

16. An assembly (10) as set forth in claim 15 further defined by one of said halves (88, 90) including a locator clip (94) for attaching to a diver's mask strap and for locating said hole (92) a predetermined distance above the waterline.

17. An assembly (10) as set forth in claim 16 further defined by said mouthpiece (24) including a length of mouthpiece tube (104) adapted to connect with said snorkel tube (12).

* * * * *